US007926253B2

(12) United States Patent
Tseng

(10) Patent No.: US 7,926,253 B2
(45) Date of Patent: Apr. 19, 2011

(54) METHOD OF MAKING A TEXTILE PRODUCT FROM A FIBER BLEND INCLUDING WOOL FIBERS AND A WOVEN TEXTILE PRODUCT MADE THEREFROM

(75) Inventor: Kun-Yu Tseng, Chiayi County (TW)

(73) Assignee: Canbelin Industrial Co., Ltd., Chia-Yi (TW)

( * ) Notice: Subject to any disclaimer, the term of this patent is extended or adjusted under 35 U.S.C. 154(b) by 109 days.

(21) Appl. No.: 12/418,740

(22) Filed: Apr. 6, 2009

(65) Prior Publication Data

US 2010/0252138 A1 Oct. 7, 2010

(51) Int. Cl.
*D02G 3/02* (2006.01)
*D02G 3/22* (2006.01)

(52) U.S. Cl. ..... 57/254; 57/256

(58) Field of Classification Search ..... 57/252, 57/254, 256

See application file for complete search history.

(56) References Cited

U.S. PATENT DOCUMENTS 3,871,165 A * 3/1975 Ishizawa et al. ..... 57/284
3,964,279 A * 6/1976 Nagata et al. ..... 68/205 R
6,330,786 B1 * 12/2001 Settle ..... 57/200
6,716,256 B2 * 4/2004 Umehara et al. ..... 8/128.1

OTHER PUBLICATIONS

Kathryn L Hatch, Textile Science, 1993, West Publishing Company, 1st edition, p. 144.*

* cited by examiner

*Primary Examiner* — Shaun R Hurley
(74) *Attorney, Agent, or Firm* — Ladas & Parry LLP

(57) ABSTRACT

A method of making a textile product includes the steps of: first-steaming a first fiber bundle; twisting the first fiber bundle; second-steaming the first fiber bundle; drawing the first fiber bundle; third-steaming the first fiber bundle; untwisting the first fiber bundle; producing long hollow polypropylene filaments; drawing the polypropylene filaments; heating the polypropylene filaments; crimping the polypropylene filaments, followed by heating and shape-setting the same in an oven; cutting the polypropylene filaments into staple fibers, followed by forming the staple fibers into a second fiber bundle; mixing the first and second fiber bundles to obtain a fiber blend; and spinning the fiber blend.

8 Claims, 1 Drawing Sheet

METHOD OF MAKING A TEXTILE PRODUCT FROM A FIBER BLEND INCLUDING WOOL FIBERS AND A WOVEN TEXTILE PRODUCT MADE THEREFROM

BACKGROUND OF THE INVENTION

1. Field of the Invention

This invention relates to a method of making a textile product, more particularly to a method of making a textile product from a fiber blend including wool fibers.

2. Description of the Related Art

Natural wool fibers are usually manufactured into textile products, such as sweaters, suits and blankets, due to their softness and ability to retain heat. Generally, the quality of natural wool fibers is determined by their length and diameter. Since natural wool fibers are increasingly affected by global warming, the natural wool fibers have become short and coarse, which results in low quality wool fibers. In addition, since natural wool fibers are expensive, textile products made therefrom are of high price. Moreover, because the bulk density of the natural wool fibers is about 1.31, the product made therefrom is relatively heavy and uncomfortable to the user.

SUMMARY OF THE INVENTION

Therefore, an object of the present invention is to provide a method of making a textile product with the prior art.

Another object of this invention is to provide a woven textile product produced by the method.

According to one aspect of the present invention, the method of making a textile product comprises the steps of:

First-steaming a first fiber bundle consisting of natural wool fibers;

twisting the first fiber bundle after the first-steaming step so that the first fiber bundle has a twist of 30 turns per meter;

second-steaming the first fiber bundle after the twisting step;

drawing the first fiber bundle through a drawing device after the second-steaming step;

third-steaming the first fiber bundle which has been drawn;

untwisting the first fiber bundle by a reverse-twisting process after the third-steaming step;

producing long hollow polypropylene filaments through a spinneret;

drawing the polypropylene filaments through three rollers rotating at different speeds;

heating the polypropylene filaments which have been drawn through an oven having a temperature of 100° C.;

crimping, after the heating step, the polypropylene filaments in a stuffer box crimper, followed by heating and shape-setting the same in an oven having a temperature of 120° C.;

cutting the polypropylene filaments which have been shape-set into staple fibers, followed by forming the staple fibers into a second fiber bundle;

mixing the untwisted first fiber bundle and the second fiber bundle to obtain a fiber blend; and spinning the fiber blend to form a yarn.

According to another aspect of the present invention, a woven textile product made by the aforesaid method comprises a plurality of yarns interlaced with each other and each spun from a fiber blend. The fiber blend includes a plurality of natural wool fibers that are substantially helical, and a plurality of hollow polypropylene filaments.

BRIEF DESCRIPTION OF THE DRAWING

Other features and advantages of the present invention will become apparent in the following detailed description of the preferred embodiment of this invention, with reference to the accompanying drawing, in which.

DETAILED DESCRIPTION OF THE PREFERRED EMBODIMENT

Figure 1:
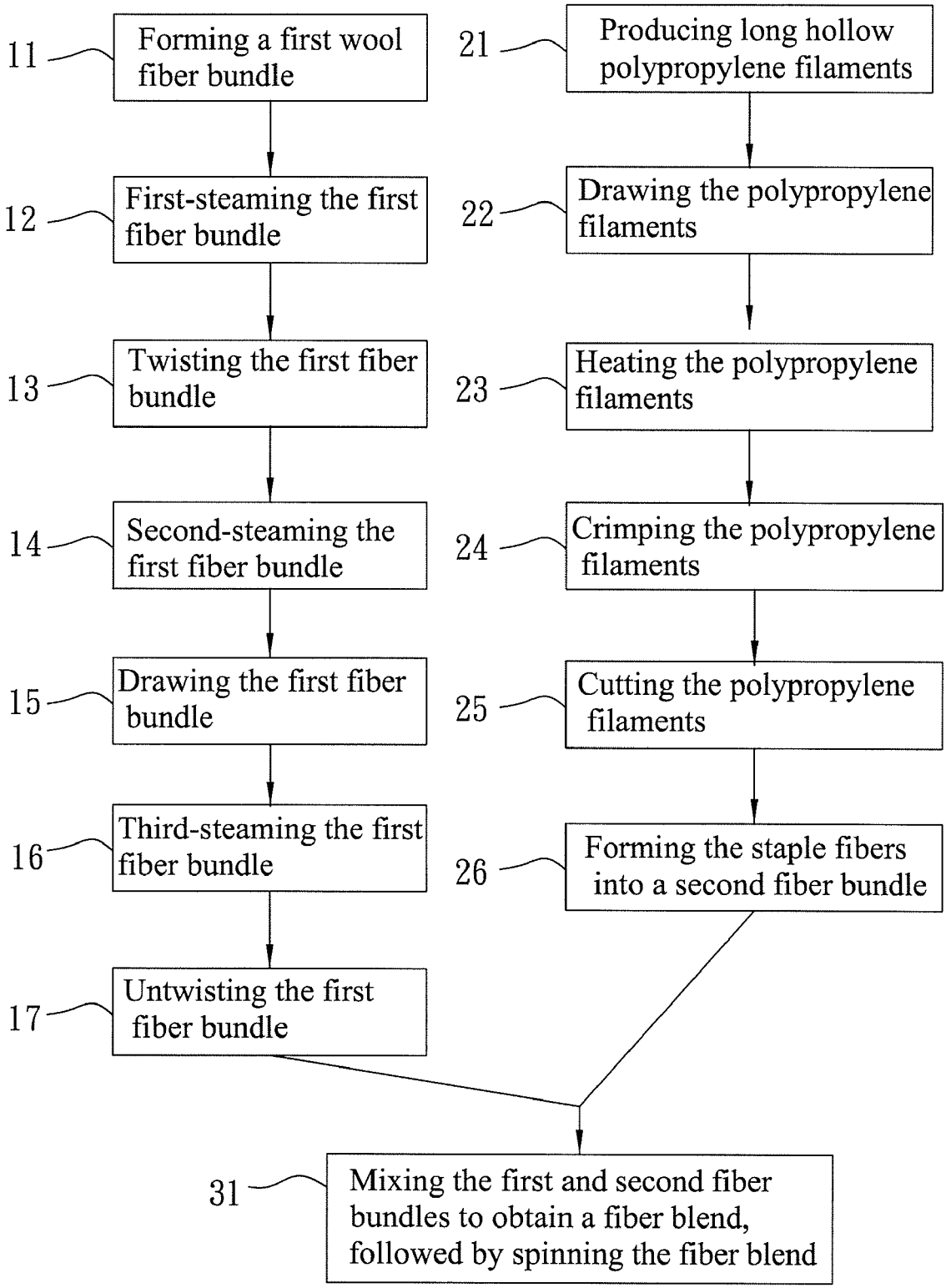
FIG. 1 is a flowchart to illustrate consecutive steps of a preferred embodiment of the method of making a textile product according to this invention.

Referring to FIG. 1, a method of making a textile product according to a preferred embodiment of the invention includes a natural wool fiber producing process, a polypropylene fiber producing process, and a process of spinning and weaving wool and polypropylene fibers.

The wool fiber producing process includes steps 11 to 17.

In step 11, wool fibers having a length of about 70 mm are processed to form a wool fiber bundle having a diameter of about 2 cm.

In step 12, the wool fiber bundle is passed through a first steamer at a speed of 30 m/min so as to conduct a first-steaming step, in which the wool fiber bundle absorbs steam provided by the first steamer so that the wool fiber bundle contains moisture and is heated to a temperature of 60° C.

In step 13, the wool fiber bundle is twisted after step 12 so that the wool fiber bundle has a twist of 30 turns per meter, thereby improving tensile strength thereof.

In step 14, the wool fiber bundle, after step 13, is passed through a second steamer at a speed of 30 m/min so as to conduct a second-steaming step, in which the wool fiber bundle is heated to a temperature of 80° C.

In step 15, the wool fiber bundle is moved through a drawing device at a rate of 30 m/min, and is drawn at a rate of 47 m/min by the drawing device. By means of the difference between the rates before and after the drawing device, the wool fiber bundle is drawn.

In step 16, the wool fiber bundle, after step 15, is passed through a third steamer at a speed of 30 m/min so as to conduct a third-steaming step, in which the shape of the twisted wool fiber bundle is set through the heat of steam.

In step 17, the wool fiber bundle is untwisted by a reverse-twisting process after step 16.

It is worth mentioning that a length of the wool fiber bundle after the drawing step is at least 1.5 times a length of the wool fiber bundle before the drawing step. In this embodiment, the length of the wool fiber bundle is about 70 mm before the drawing step and increases to about 110 mm after the drawing step, thereby providing a smooth surface for the wool fiber bundle. In addition, the wool fibers of the wool fiber bundle are substantially helical after the untwisting step.

The polypropylene fiber producing process includes steps 21 to 26.

In step 21, polypropylene melt is extruded at 230° C. through a spinneret so as to produce long hollow polypropylene filaments, and then cooled to room temperature using cold air having a temperature of 20° C.

In step 22, the hollow polypropylene filaments are passed through three heated rollers, which respectively rotate at 800 m/min, 1200 m/min, and 2000 m/min, and respectively have temperatures of 60° C., 100° C. and 130° C. Since the three rollers have different rotating speeds and temperatures, the hollow polypropylene filaments are drawn to a length that is 2.5 times a length of the hollow polypropylene filaments before passing through the three rollers. Tensile strength of the hollow polypropylene filaments at room temperature is therefore enhanced.

In step 23, the hollow polypropylene filaments are moved at a rate of 30 m/min and heated through an oven having a temperature of 100° C.

In step 24, the hollow polypropylene filaments are passed through a stuffer box crimper that is substantially conical in shape and that has an inlet and an outlet which has a smaller cross sectional area than that of the inlet. The hollow polypropylene filaments enter the inlet at a rate of 30 m/min and exit from the outlet at a rate of 15 m/min. By means of the difference of the rates at the inlet and the outlet, the hollow polypropylene filaments are squeezed, folded and bent, thereby forming crimps in the hollow polypropylene filaments. Subsequently, the crimped hollow polypropylene filaments are heated through an oven having a temperature of 120° C. for shape-setting.

In step 25, the hollow polypropylene filaments are cut into staple fibers having a length of about 110 mm.

In step 26, the staple fibers are formed into a polypropylene fiber bundle having a diameter of about 2 cm.

In step 31, the wool and polypropylene fiber bundles are mixed to obtain a fiber blend and are then spun into yarns. The ratio of the wool fiber bundle to the polypropylene fiber bundle in the fiber blend can be varied depending on actual requirements. For example, the wool fiber bundle and the polypropylene fiber bundle are mixed in a ratio of 1:1.

Finally, the yarns are woven into the textile product.

The woven textile product as produced by the method according to the present invention includes a plurality of yarns interlaced with each other and each spun from a fiber blend. The fiber blend includes a plurality of natural wool fibers and a plurality of hollow polypropylene filaments.

In the textile product of this invention, each yarn includes the wool fibers, which have a length of about 110 mm and are substantially helical by virtue of the twisting and untwisting steps, and the polypropylene filaments which have a length of about 110 mm. Due to the hollow structure of the polypropylene filaments which can retain heat, the textile product can provide the same warming effect as that purely consisting of natural wool fibers. In addition, the polypropylene filaments have a density of 0.91, which is less than that of the wool fibers. Therefore, the textile product including the fiber blend is lighter and more comfortable as compared to that made only from natural wool fibers. Further, the polypropylene filaments are less expensive than the wool fibers. Moreover, the wool fibers processed by the method according to the present invention possess smooth surfaces and high fineness, thereby improving quality of the textile product.

With the invention thus explained, it is apparent that various modifications and variations can be made without departing from the spirit of the present invention. It is therefore intended that the invention be limited only as recited in the appended claims.

What is claimed is:

1. A method of making a textile product, comprising the steps of:

first-steaming a first fiber bundle consisting of natural wool fibers;

twisting the first fiber bundle after the first-steaming step so that the first fiber bundle has a twist of 30 turns per meter;

second-steaming the first fiber bundle after the twisting step;

drawing the first fiber bundle through a drawing device after the second-steaming step;

third-steaming the first fiber bundle which has been drawn;

untwisting the first fiber bundle by a reverse-twisting process after the third-steaming step;

producing long hollow polypropylene filaments through a spinneret;

drawing the polypropylene filaments through three rollers rotating at different speeds;

heating the polypropylene filaments which have been drawn through an oven having a temperature of 100° C.;

crimping, after the heating step, the polypropylene filaments in a stuffer box crimper, followed by heating and shape-setting the same in an oven having a temperature of 120° C.;

cutting the polypropylene filaments which have been shape-set into staple fibers, followed by forming the staple fibers into a second fiber bundle;

mixing the untwisted first fiber bundle and the second fiber bundle to obtain a fiber blend; and spinning the fiber blend to form a yarn.

2. The method of claim 1, wherein a length of the first fiber bundle after the drawing step is at least 1.5 times a length of the first fiber bundle before the drawing step.

3. The method of claim 2, wherein the length of the first fiber bundle is about 70 mm before the drawing step and increases to about 110 mm after the drawing step.

4. The method of claim 1, wherein the first fiber bundle moves at a rate of 30 m/min before and after the drawing step, and is drawn at a rate of 47 m/min by the drawing device.

5. The method of claim 1, wherein the wool fibers of the first fiber bundle are substantially helical after the untwisting step.

6. The method of claim 1, wherein the three rollers respectively rotate at 800 m/min, 1200 m/min, and 2000 m/min, and respectively have temperatures of 60° C., 100° C. and 130° C.

7. The method of claim 6, wherein a length of the polypropylene filaments after passing through the three rollers is 2.5 times a length of the polypropylene filaments before passing through the three rollers.

8. The method of claim 1, wherein the wool fibers and the polypropylene filaments in the fiber blend have a length of about 110 mm, and the wool fibers are substantially helical.

* * * * *